US010473056B2

(12) United States Patent
Miller et al.

(10) Patent No.: US 10,473,056 B2
(45) Date of Patent: Nov. 12, 2019

(54) PISTON

(71) Applicant: FEDERAL-MOGUL LLC, Southfield, MI (US)

(72) Inventors: Andrew J. Miller, Plymouth, MI (US); Bruce Inwood, Fenton, MI (US); Marc Brandt, Walled Lake, MI (US)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 16/103,217

(22) Filed: Aug. 14, 2018

(65) Prior Publication Data

US 2018/0355819 A1 Dec. 13, 2018

Related U.S. Application Data

(63) Continuation of application No. 14/928,033, filed on Oct. 30, 2015, now Pat. No. 10,087,881.

(60) Provisional application No. 62/072,748, filed on Oct. 30, 2014.

(51) Int. Cl.

| | |
|---|---|
| ***F02F 3/28*** | (2006.01) |
| ***F02F 3/00*** | (2006.01) |
| ***F02F 3/22*** | (2006.01) |
| ***F02F 3/20*** | (2006.01) |
| ***F01M 1/08*** | (2006.01) |

(Continued)

(52) U.S. Cl.

CPC ..... *F02F 3/28* (2013.01); *F02F 3/00* (2013.01); *F02F 3/0084* (2013.01); *F02F 3/20* (2013.01); *F02F 3/22* (2013.01); *F01M 1/08* (2013.01); *F01P 3/06* (2013.01); *F01P 3/08* (2013.01); *F05C 2201/0448* (2013.01)

(58) Field of Classification Search

CPC ..... F01P 3/06; F01P 3/08; F05C 2201/0448; F01M 1/08

See application file for complete search history.

(56) References Cited

U.S. PATENT DOCUMENTS

2004/0216605 A1 11/2004 Nigro et al.
2010/0108001 A1* 5/2010 Scharp ..... B23P 15/10 123/41.35
2011/0120410 A1* 5/2011 Gu ..... F02B 23/105 123/275

FOREIGN PATENT DOCUMENTS

CN 201461121 U 5/2010
CN 103670776 A 3/2014

(Continued)

*Primary Examiner* — Jacob M Amick
*Assistant Examiner* — Charles Brauch
(74) *Attorney, Agent, or Firm* — Robert L. Stearns; Dickinson Wright, PLLC

(57) ABSTRACT

A ferrous piston for gasoline powered engines having dimensions which achieve reduced mass and improved performance is provided. The piston crown has a thickness of less than 4 mm and includes valve pockets with an axial clearance between the valve pockets and an uppermost ring groove of less than 1.5 mm. The pin bosses have an axial thickness of less than 3.7% of a bore diameter, which is the largest outer diameter of the piston, measured between a pin bore and the crown at 1 mm from an inner face forming the pin bore. Each pin boss has a radial thickness of less than 3% of the bore diameter measured between the pin bore and a lower end of the pin boss. An undercrown surface presents a projected area of less than 45% of a total piston bore area, wherein the total piston bore area is $\pi BD^2/4$, BD being the bore diameter.

15 Claims, 10 Drawing Sheets

(51) Int. Cl.
*F01P 3/08* (2006.01)
*F01P 3/06* (2006.01)

(56) References Cited

FOREIGN PATENT DOCUMENTS

| | | | |
|---|---|---|---|
| JP | 2000179345 | A | 6/2000 |
| JP | 2015511676 | A | 4/2015 |

* cited by examiner

PISTON

CROSS REFERENCE TO RELATED APPLICATION

This U.S. Continuation Application claims the benefit of U.S. Utility patent application Ser. No. 14/928,033, filed Oct. 30, 2015, which claims the benefit of U.S. Provisional Application No. 62/072,748, filed Oct. 30, 2014, the entire disclosure of which is incorporated herein by reference.

BACKGROUND OF THE INVENTION

1. Field of the Invention

This invention relates to pistons for internal combustion engines, and particularly those made of ferrous material.

2. Related Art

Pistons for gasoline engines used in passenger and light and medium duty truck applications are typically made of aluminum. Aluminum is light, relatively easy to cast, and relatively inexpensive to make for large volume usage. Vehicle manufactures arc demanding more power and improved fuel economy out of the same or smaller size engines. Such requirements present a challenge to piston manufactures since there are presently limits on what can be achieved with a standard aluminum piston. For example, the aluminum pistons may not be able to perform adequately under increased temperatures and pressures caused by advanced technologies used to achieve more power and fuel economy. In order to withstand and perform under the increased combustion temperatures and pressures, some piston manufactures have taken to using steel pistons. Such steel pistons oftentimes include one or more closed cooling galleries to retain cooling oil for cooling the upper crown, which is directly exposed to the high temperatures and pressures of the combustion chamber.

SUMMARY OF THE INVENTION

A piston for an internal combustion engine is fabricated of ferrous material and has certain dimensional relationships that enable the piston to meet and exceed the increasing demands on passenger vehicles and light/medium duty trucks that utilize gasoline powered engines. The dimensions of the piston provide an overall reduction in mass and costs, as well as improved performance, The piston is also manufactured without any closed oil cooling galleries, which provides for further reduction in mass and costs, According to one aspect, the piston has a bore diameter BD, which corresponds to the largest outer diameter measurement of the piston body, and a pair of piston skirt portions. The skirt portions each have a projected skirt area that corresponds to the projected surface of the respective skirt portion in a plane perpendicular to a pin bore axis of the piston, The combined projected area of the skirts is SA<40% $\pi BD^2/4$, wherein $\pi BD^2/4$ is the total piston bore area. This relatively small piston skirt area SA is less than that of known aluminum pistons of the same bore diameter BD and provides needed guidance for a ferrous piston with reduced friction and mass, According to another aspect, the pin bore projected area PBA is less than 10% of the total piston bore area. In other words, PBA<10% of $\pi BD^2/4$, where PBA is the area of the upper half of the pin bore surface projected onto a plane containing the pin bore axis and perpendicular to a central axis of the piston. The relatively small pin bore projected area PBA in relation to the size of the total piston bore area contributes to low friction, low mass, and low packaging of the piston.

According to another aspect, the piston has a crown with a wall thickness that is less than 4 mm. The crown thickness of a comparable aluminum piston is greater than 4.5 mm. The relatively thin crown of the subject ferrous piston contributes to an overall reduction in mass and improved performance of the piston.

According to another aspect, the piston has a projected undercrown area UA measured at less than 4 mm from the crown surface that is >45% of $\pi BD^2/4$.

According to another aspect, the piston has thin wall sections at the bottom of the pin bosses. In particular, the radial thickness of the pin bosses measured at the bottom of the pin bosses is less than 3% of the bore diameter BD. The relatively thin pin boss bottom wall regions contribute to a reduction in mass and also a reduction in the overall height of the piston.

According to another aspect, the pin bosses are free of any metallic bearing inserts (or shells) and the top, axially inner edge regions of the pin bosses are sufficiently thin to permit flexing of the pin bosses under load. Piston dynamics are such that the upper portion of the pin bosses experience greater loading during operation than the lower portion. It is not unusual for the pin bore surface in the upper region to be contoured in the axial direction to accommodate flexing of the wrist pin under load so as not to overly stress or damage the piston or pin. According to the present aspect, the thinning of the upper pin boss wall of the ferrous piston can advantageously eliminate the need for costly and time consuming contour machining of the pin bore. In particular, a straight bore, with no axial contour apart from retainer clip grooves and a standard chamfer, can be utilized when the radial thickness of the top inner edge regions of the pin bosses, measured at a distance of 1 mm inward from the axially inner face of the pin bosses, is <3.7% of the bore diameter BD.

According to another aspect, the upper portion of the pin bosses between the pin bores and undercrown is cored out. The core may take the form of a deep recess or a fully open window. The cored feature contributes to a reduction in piston mass and increase in performance, and the provision of fully open windows or through passages has the further benefit of providing a passage for cooling oil to flow from the central undercrown space between the pin bosses to the two lateral undercrown spaces outboard of the pin bosses. The supplemental cooling to these outboard areas enables the size of these areas to be larger without concern for inadequate cooling.

According to another aspect, the aforementioned coring in the form of deep recesses is greater than 2 mm in depth commencing at the inner faces of the pin bosses.

According to another aspect, the aforementioned coring in the form of fully open windows presents each pin boss with a pair of pin boss piers that each have a thickness <9.5% of the bore diameter BD. Such relatively thin pier sections are possible with the ferrous material and contribute to the reduction in mass of the piston.

According to another aspect, cored panel windows have upper edges thereof that extend to within at least 2 mm of being flush with the undercrown surface of the piston. Such high windows maximize the exposed undercrown surface and minimize thick sections adjacent the undercrown that may hold heat.

According to another aspect, the thin piston crown section, piston skirts, and/or panels may be provided with ribs that are localized to provide added strength and rigidity if and where needed without increasing the thickness of the entire crown, panels, and/or skirts. The stiffening ribs of the crown, when present, have a thickness <4% of the bore diameter BD.

According to another aspect, the crown of the piston includes a valve pocket formed therein, above the uppermost ring groove. The axial clearance between the valve pocket and the uppermost ring groove is no greater than about 1.5 mm, lending to a compact piston configuration, According to another aspect, the top land has an axial thickness <3% of the bore diameter ED, which also contributes to the compact configuration of the piston.

According to another aspect, the piston includes a second land separating first and second ring grooves, which has an axial thickness <3.5% of the bore diameter BD, which also contributes to the compact configuration of the piston.

According to another aspect, the compression height CH of the subject ferrous piston is relatively small. In particular, the compression height CH is <30% of the bore diameter ED. Such a small compression height contributes to a reduction in piston mass and also to a compact piston configuration.

According to another aspect, the cord width of the skirts at the interface with the ring belt should be 30% to 60% of the bore diameter ED. Such a skirt cord width relationship enables the ring lands to be supported with low ring groove wave distortion and low mass, both of which are advantageous to piston performance.

According to another aspect, the piston includes skirt panels extending between and bridging the pin bosses and the skirts. The skirt panels are thin and compliant which lends to a reduction in friction, reduction in mass and improvement in performance. Each panel has a thickness less than 2.2 mm, whereas a corresponding aluminum piston would have a panel thickness of more than 2.5 mm. The skirt panels are preferably inwardly or outward curved to greater than 0.7 mm out of plane such that the panels bow inward or outward when viewed parallel to the pin axis. The curved panels lend rigidity to the panels and support to the piston structure allowing an accompanying reduction in mass.

According to another aspect, the skirts each have wing portions that project laterally outwardly of the skirt panels by more than 1 mm at the level of the pin bore axis, Wings of this size are beneficial in reducing skirt edge loading.

BRIEF DESCRIPTION OF THE DRAWINGS

Example embodiments are illustrated in the drawings and described in the accompanying detailed description as follows.

Other advantages of the present invention will be readily appreciated, as the same becomes better understood by reference to the following detailed description when considered in connection with the accompanying drawings wherein:

DETAILED DESCRIPTION

Figure 1:
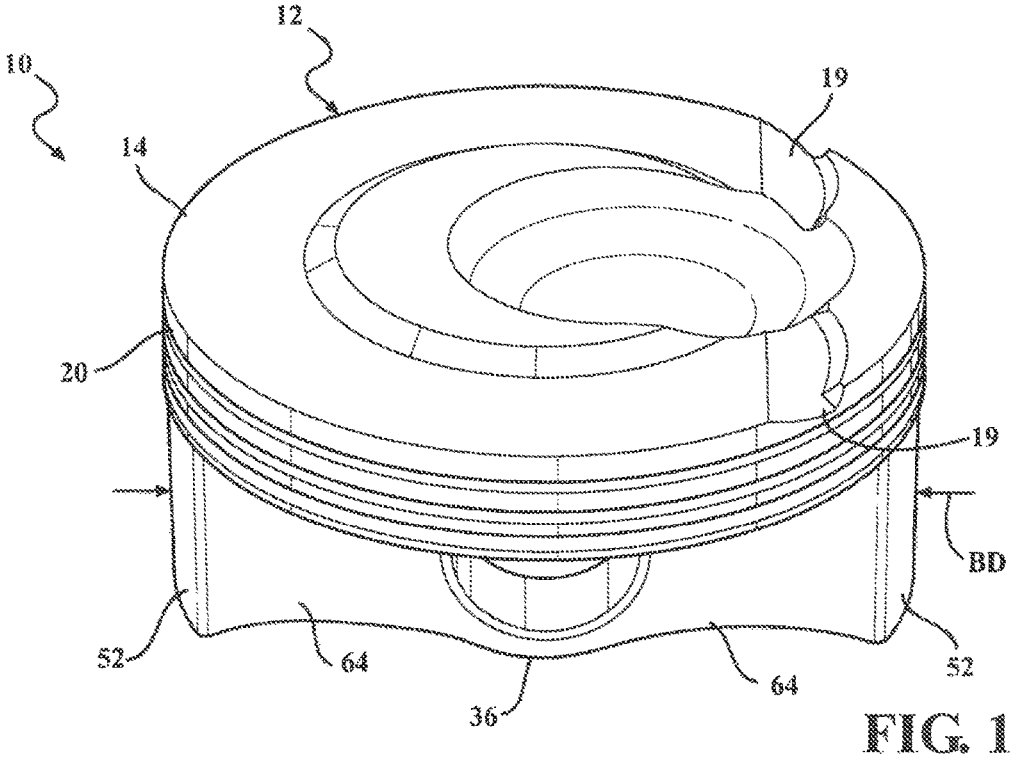
FIG. 1 is a top perspective view of a piston according to an example embodiment.
Figure 2:
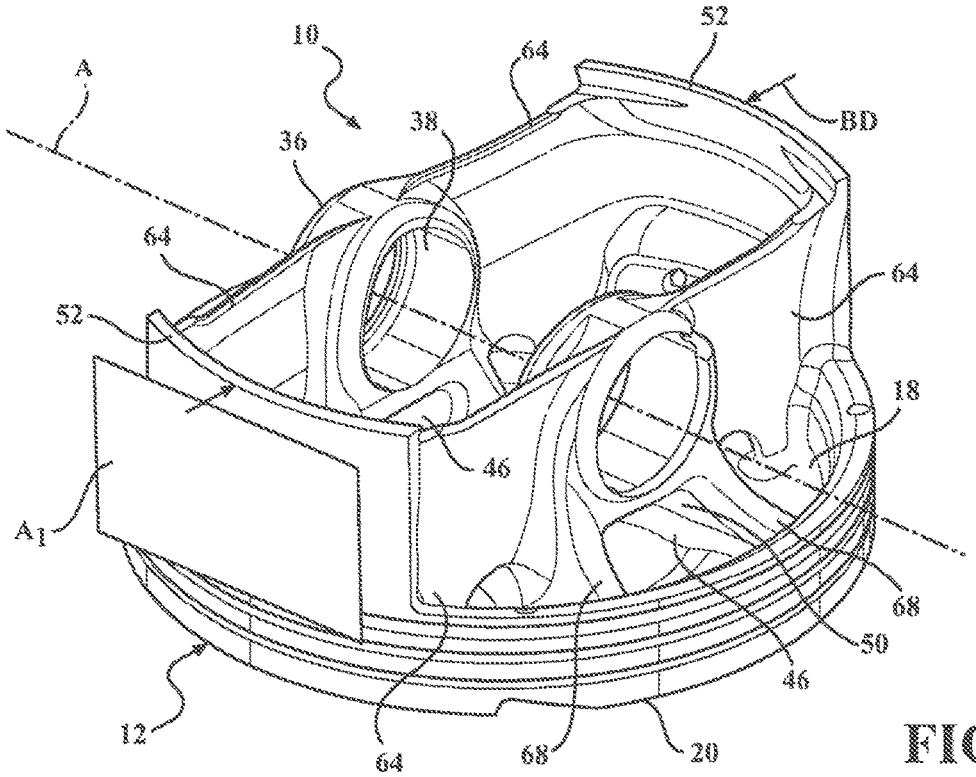
FIG. 2 is a bottom perspective view of the piston of FIG. 1.

A piston according to an embodiment of the invention is illustrated at 10 in FIGS. 1 and 2 and includes a piston body 12 fabricated as a single piece from a ferrous material, Steel is the preferred ferrous material, such as SAE 4140 alloy. The piston 10 may be cast, forged, powder metal or machined from a billet.

Figure 3:
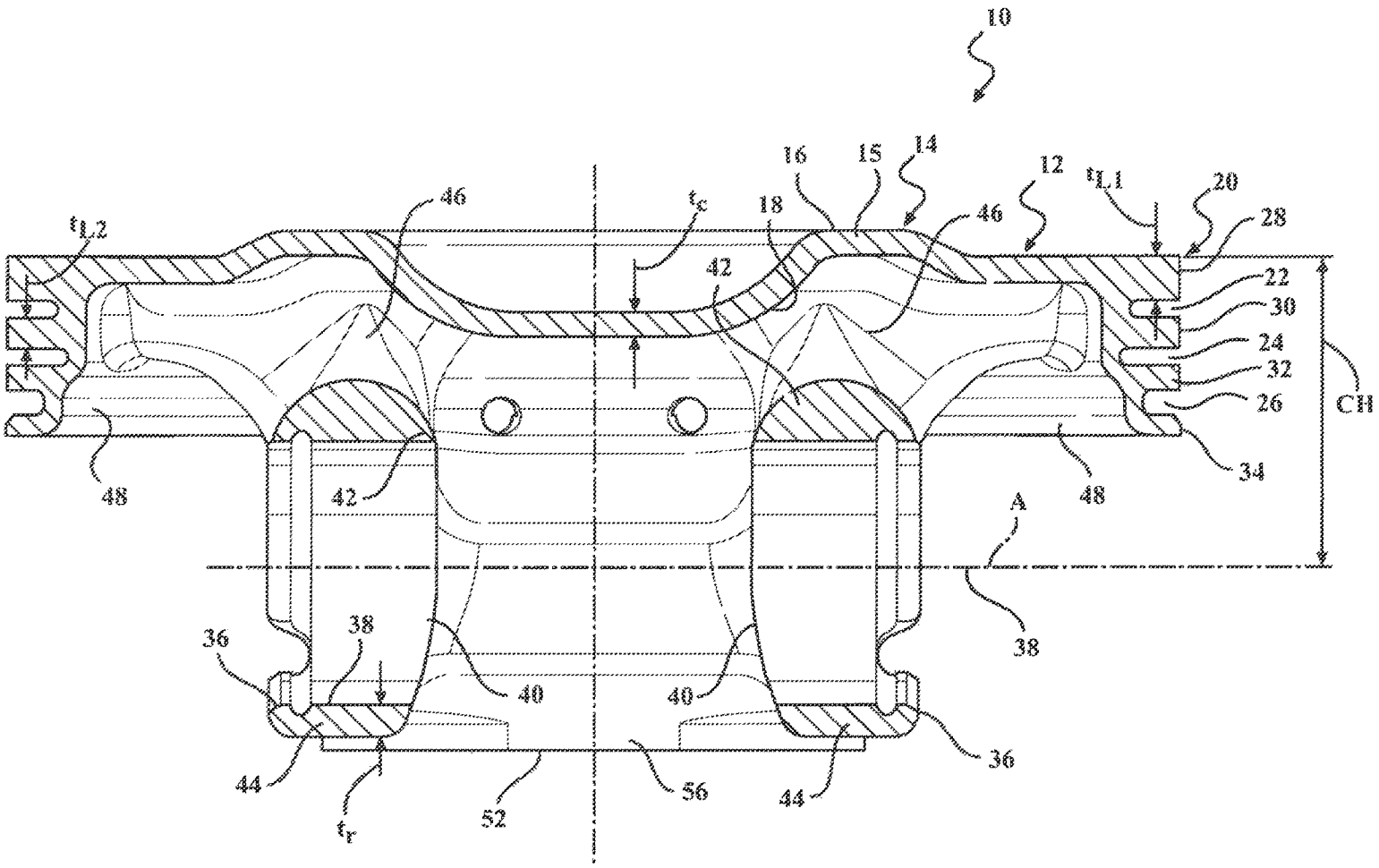
FIG. 3 is a cross sectional view of the piston of FIG. 1 through the pin bore axis.

The piston 10 includes a piston crown 14 which is the top portion of the piston 10. As shown in FIG. 3, the piston crown 14 includes a solid crown wall 15 having an upper surface 16 that is exposed to combustion gases during operation and an opposite lower or undercrown surface 18 that is exposed to cooling oil during operation. The crown wall 15 may be contoured to include features such as valve pockets 19. In this embodiment, and as further illustrated in FIG. 3, the crown wall 15 is designed to be very thin and of generally uniform thickness throughout. It is preferred that the crown wall thickness $t_c$ be less than 4 mm. Such a thin crown wall 15 reduces the mass of the piston 10 and provides rapid and relatively uniform conduction and dissipation of heat of combustion from the upper surface 16 to the undercrown 18 as cooling oil splashes against the undercrown surface 18.

The piston 10 has a bore diameter BD, as illustrated in FIG. 1, which corresponds to the largest outer diameter measurement of the piston body 12. In the illustrated embodiment, the piston 10 has a bore diameter BD of 92.5 mm. Such a bore diameter BD is typical for automotive passenger vehicles and light and medium duty pick-up trucks.

The piston crown 14 includes a ring belt 20 in the form of a band of metal that surrounds and projects downward from the upper crown surface 16. The ring belt 20 is fabricated as one piece with the piston body 12 and includes a first or uppermost ring groove 22, a second or middle ring groove 24, and a third or bottom ring groove 26. The upper two ring grooves 22, 24 are configured to receive compression rings (not shown) while the bottom ring groove 26 is configured to receive an oil control ring (not shown). A top land 28 of the ring belt 20 separates the first ring groove 22 from the upper crown surface 16. A second land 30 separates the first and second ring grooves 22, 24, while a third land 32 separates the second and third ring grooves 24, 26. A bottom land 34 forms the bottom support wall for the lower ring groove 26. In the illustrated embodiment, the top land 28 has an axial thickness $t_{L1}$ of less than 3% of the bore diameter BD of the piston 10, whereas the second land 30 has an axial thickness $t_{L2}$ of <3.5% of the bore diameter BD. Such small land dimensions contribute to a compact (short) piston design and thus a reduction in mass and increase in performance.

Figure 8:
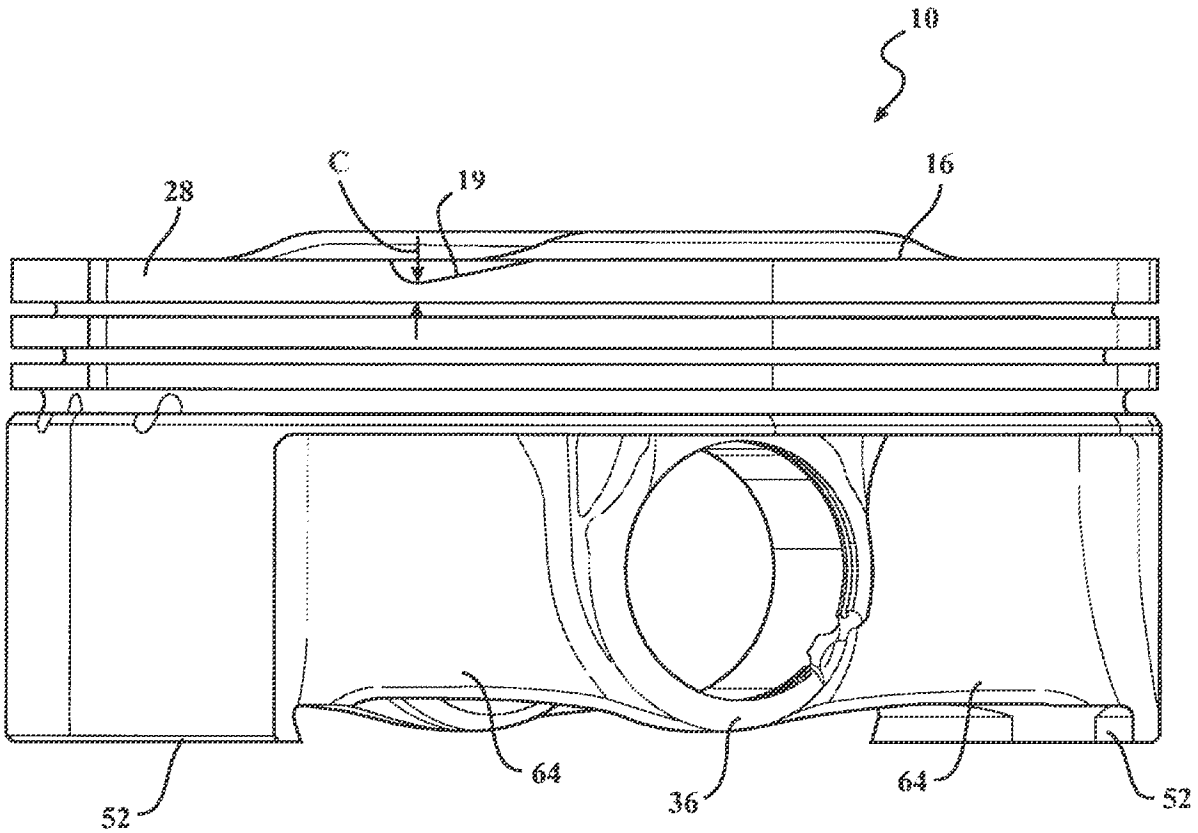
FIG. 8 is an elevation view of the piston of FIG. 1.

As shown best in FIGS. 1, 2 and 8, the valve pockets 19 may be provided in the crown 14. When the valve pocket 19 is present, the axial clearance C between the valve pocket 19 and the uppermost ring groove 22 is <1.5 mm. Such a deep penetration of the valve pocket 19 into the piston crown 14 contributes to an overall compact design of the piston 10 as well as a reduction in mass and improvement in performance.

The piston 10 includes a pair of pin bosses 36 that are formed as one piece with the piston body 12. The pin bosses 36 project downwardly from the undercrown surface 18 of the piston 10 and are formed with pin bores 38 that are axially aligned along a pin bore axis A that is arranged perpendicular to a central longitudinal axis B of the piston body 12. The pin bores 38 present bearingless running surfaces, meaning that the bores 38 are free of metallic bearing sleeves. The pin bores 38 are preferably coated with a low friction, oleophilic coating material, such as manganese phosphate, for receiving and supporting a wrist pin (not shown) during operation of the piston 10. It is preferred that the entire surface of the piston 10 is coated with manganese phosphate, except for the ring grooves 22, 24, 26, which may or may not be coated. The pin bosses 36 have inner pin boss surfaces 40 that face one another and are spaced sufficiently apart to receive a connecting rod (not shown) adjacent the undercrown region for connection with the wrist pin in known manner. As shown best in FIG. 10, the pin bores 38 have an upper half surface (above the pin bore axis A) that has a projected pin bore area PBA that is <10% of the total piston bore area, which is $\pi BD^2/4$. The projected pin bore area PBA lies in a plane containing the pin bore axis A and is perpendicular to the longitudinal axis B. Such a small pin bore projected area PBA reduces the mass of the piston 10 as well as the mass of the overall piston assembly since the corresponding wrist pin is of small diameter.

The pin bosses 36 each have circumferentially continuous walls whose inner faces 40 form the pin bores 38. As illustrated best in FIG. 3, at least an uppermost portion 42 of the pin boss walls adjacent the inner faces 40 is preferably sufficiently thin to enable elastic flexing or bending of the wall portion 42 under the load of the wrist pin in operation during portions of the combustion cycle. The axial thickness $t_a$ of the wall portion 42 measured at a distance 1 mm inward from the inner face 40 is <3.7% of the bore diameter BD. The thin wall portion 42 is preferably accompanied by a straight bore profile of the pin bore 38. Normally in the same region, the pin bore 38 would be axially contoured to provide a relief area for the flexing of the wrist pin. The thinned portion 42 according to the present embodiment eliminates the need for the special machining of the relief area and instead allows for a straight bore and flexing of the wall portion 42 with the wrist pin. Such simplifies the process and reduces the cost of manufacturing pistons. It also contributes to a reduction in mass.

As also best illustrated in FIG. 3, a lower portion 44 of the pin boss walls (bottom region of the pin bosses) is also thin and preferably has a radial thickness $t_r$ that is <3% of the bore diameter BD. Such a thin lower portion 44 contributes to a reduction in mass and overall height of the piston 10.

Figure 12:
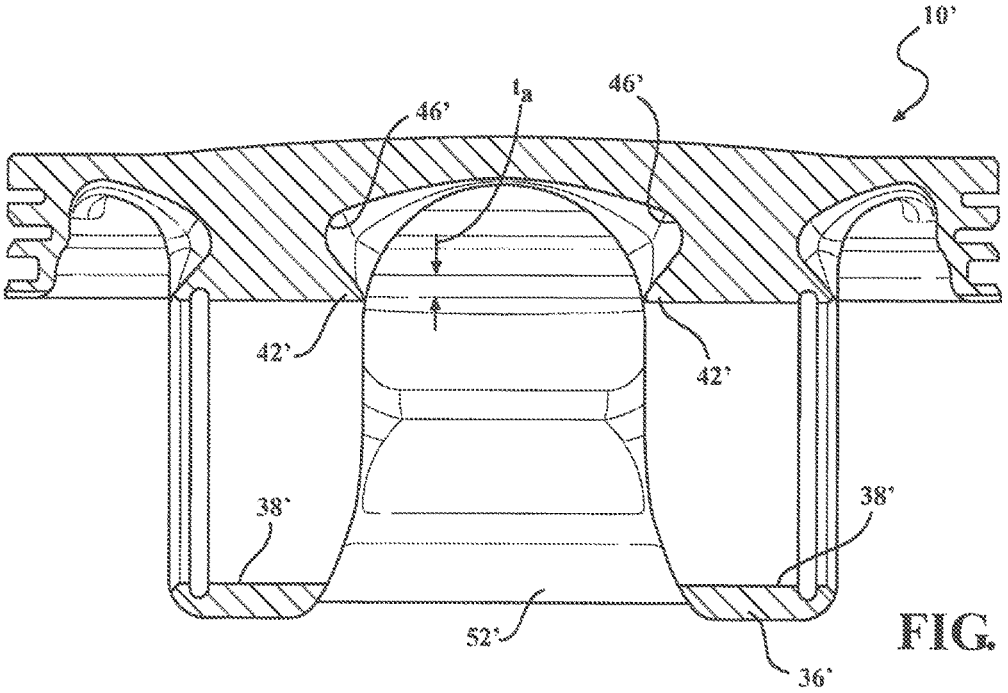
FIG. 12 is a cross sectional view of a piston according to another example embodiment.

As illustrated in FIGS. 2, 3, 4, 6, 7, 9, 10, and 12 the upper portion 42 of the pin bosses 36 is spaced from the lower crown surface 18. The resultant spaces 46 commence at the inner faces 40 of the pin bosses 36 and extend axially outward at least 2 mm and present a hollowed region 46 above the pin bosses 36 and below the undercrown surface 18. Such hollowed regions 46 reduce the mass of the piston 10 by eliminating material and also improve cooling of the piston 10 by eliminating material mass that can hold heat. The hollowed regions 46 may extend fully through the width of the pin bosses 36 and are thus in the form of fully open windows that provide a flow passage through the pin bosses 36 above the pin bores 38. FIG. 12 shows undercut hollow regions 46', whereas the remaining figures show the spaces as fully open windows 46. The windows 46 are advantageous in that still more material is eliminated, but also cooling oil introduced from below into the undercrown region between the pin bosses 36 is able to traverse the pin bosses 36 through the windows 46 to provide a direct flow of cooling oil to axial outward undercrown regions 48 that are outboard of the pin bosses 36. Without the windows 46, these outboard undercrown regions 48 would be blocked from direct flow of cooling oil by the pin bosses 36. The upper end on the windows 46 extend to within 2 mm of the undercrown surface 18 and ideally are flush with the undercrown surface 18 to maximize the height and area of the opening for improved oil flow and reduced mass.

Figure 9:
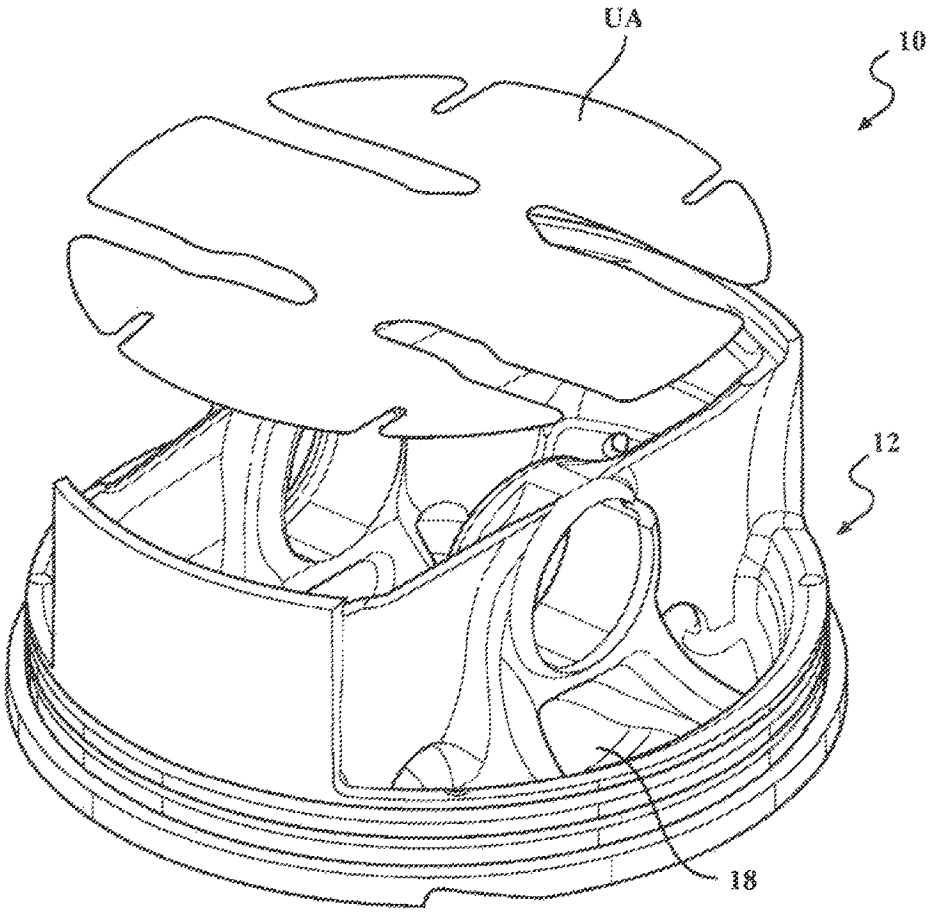
FIG. 9 is a bottom perspective view similar to FIG. 2.
Figure 10:
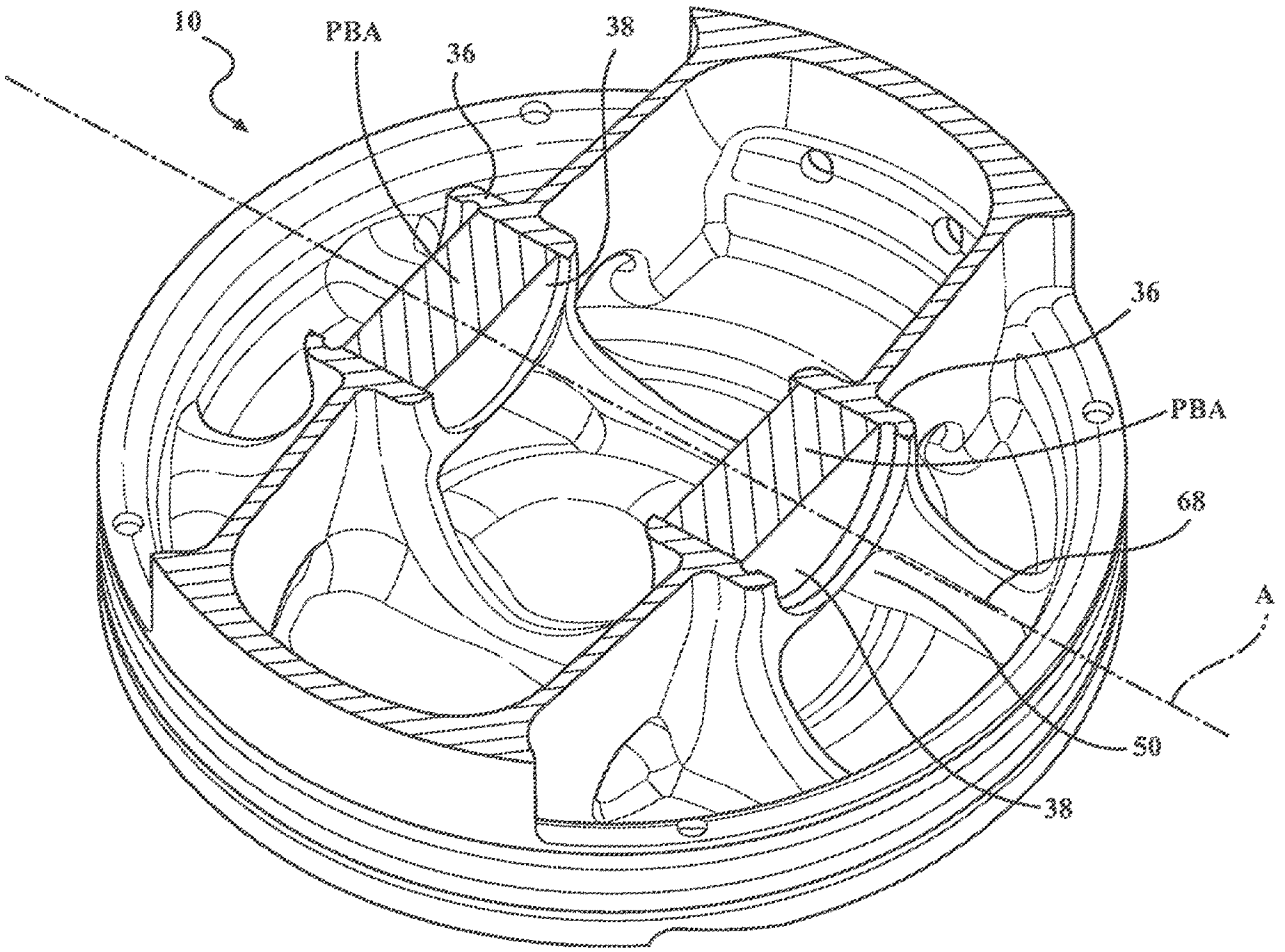
FIG. 10 is a bottom sectional view similar to FIG. 5 but in perspective.

As shown best in FIGS. 2, 9 and 10, the windows 46 are each bridged by a pair of pin boss piers 50 that are relatively thin in section. The pin boss piers 50 are located axially between the pin bosses 36 and the undercrown surface 18. Preferably, each pin boss pier 50 has a thickness <9.5% of the bore diameter BD which contributes to a reduction in mass while providing maximum oil flow between the inner and outer undercrown regions of the piston 10.

The piston 10 is very compact in the longitudinal direction (height). As illustrated best in FIG. 3, the compression height CH is measured from the pin bore axis A to the upper crown surface 16 adjacent the ring belt 20 and is <30% of the bore diameter BD. Such represents a reduction in compression height of at least 20%, compared to an aluminum piston of the same bore diameter BD suited for the same gasoline engine. Even the smallest reduction in CH is considered significant in the industry because it means that the overall height of the engine can be reduced. And with the piston 10 being steel, the reduction in CH comes with the added benefit of increased performance since the piston 10 can operate under higher compression loads for extended periods of time. In other words, smaller size, increased power and increased fuel efficiency are recognized by the preset piston 10.

Figure 11:
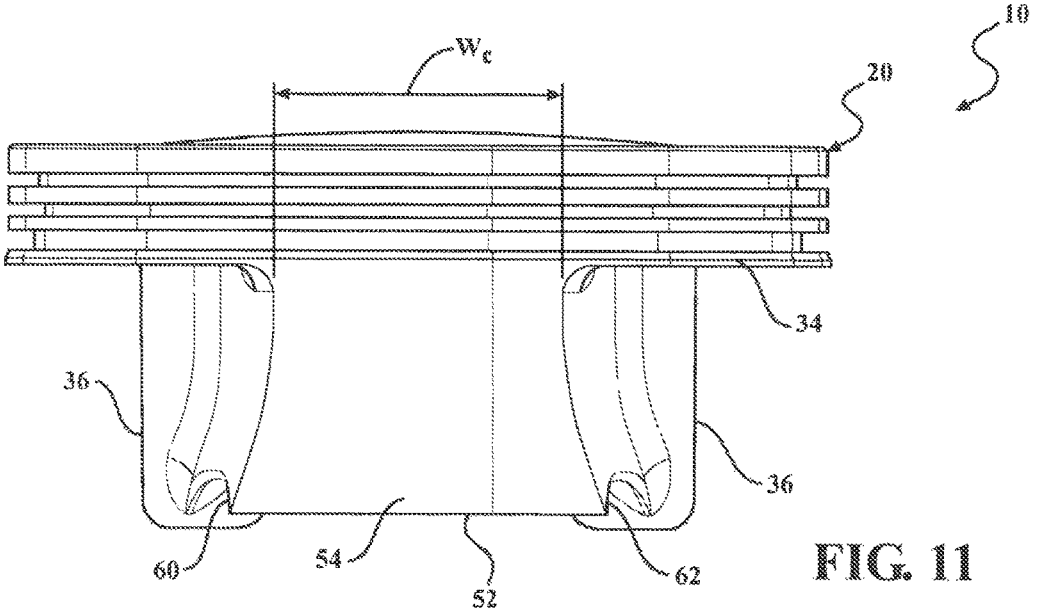
FIG. 11 is a side elevation view of the piston of FIG. 1.

As illustrated in the drawings, the piston 10 includes a pair of piston skirts 52 which have curved outer and inner surfaces 56, 58 and opposite skirt edges 60, 62. The skirts 52 are formed as one piece with the piston body 12 and the outer surfaces 54 merge at the top into the fourth land 34 of the ring belt 20. The outer surfaces 54 together provide a combined projected skirt area SA that is <40% of $\pi BD^2/4$ (i.e., less than 40% of the total piston bore area). The projected skirt area $A_1$ for one of the skirts 52 is illustrated in FIG. 2 and is the area of the outer surface 54 projected onto a plane that is parallel to the pin bore axis A and perpendicular to the longitudinal axis B of the piston 10. Such a projected small skirt area SA contributes to the overall small size, reduction in mass and increased performance of the piston 10. It also reduces friction. Even more preferably, the combined projected skirt area SA is 27-34% of the total piston bore area, $\pi BD^2/4$. As best illustrated in FIG. 11, the skirts 52 have a chord width $w_c$ where they just begin to widen and transition into the ring belt 20 that is 30% to 60% of the bore diameter BD. Such a small waisted skirt 52 contributes to low friction while providing sufficient support for low ring groove wave.

The skirts 52 are each connected directly to the pin bosses 36 by skirt panels 64. The panels 64 are formed as one piece with the pin bosses 36 and skirts 52 and are set inward of axially outer faces of the pin bosses 36. Each panel 64 has a thickness $t_{pa}$ of less than 2.2 mm, whereas a correspondingly aluminum piston would have a panel thickness of more than 2.5 mm.

The panels 64, along with the pin bosses 36, partition the undercrown surface 18 into the inner region, which is bounded by the inner surfaces of the panels 64, pin bosses 36 and skirts 52/ring belts 20, and the outer regions of the undercrown surface 18 that are outward of the pin bosses 36 and bound by the outer faces of the pin bosses 36, panels 64 and inner surfaces of the ring belt 20. The aforementioned windows 46 connect the inner and outer undercrown regions and permit the passage of cooling oil therebetween. As best illustrated in FIG. 9, the combined undercrown regions provide a projected undercrown area UA measured at less than 4 mm from the undercrown surface 18 that is >45% of the total piston bore area $\pi BD^2/4$. The projection of the area is onto a plane that is parallel to the pin bore axis A and perpendicular to the piston axis B. Such a large undercrown area UA provides enhanced cooling of the piston 10 and minimizes mass.

Figure 4:
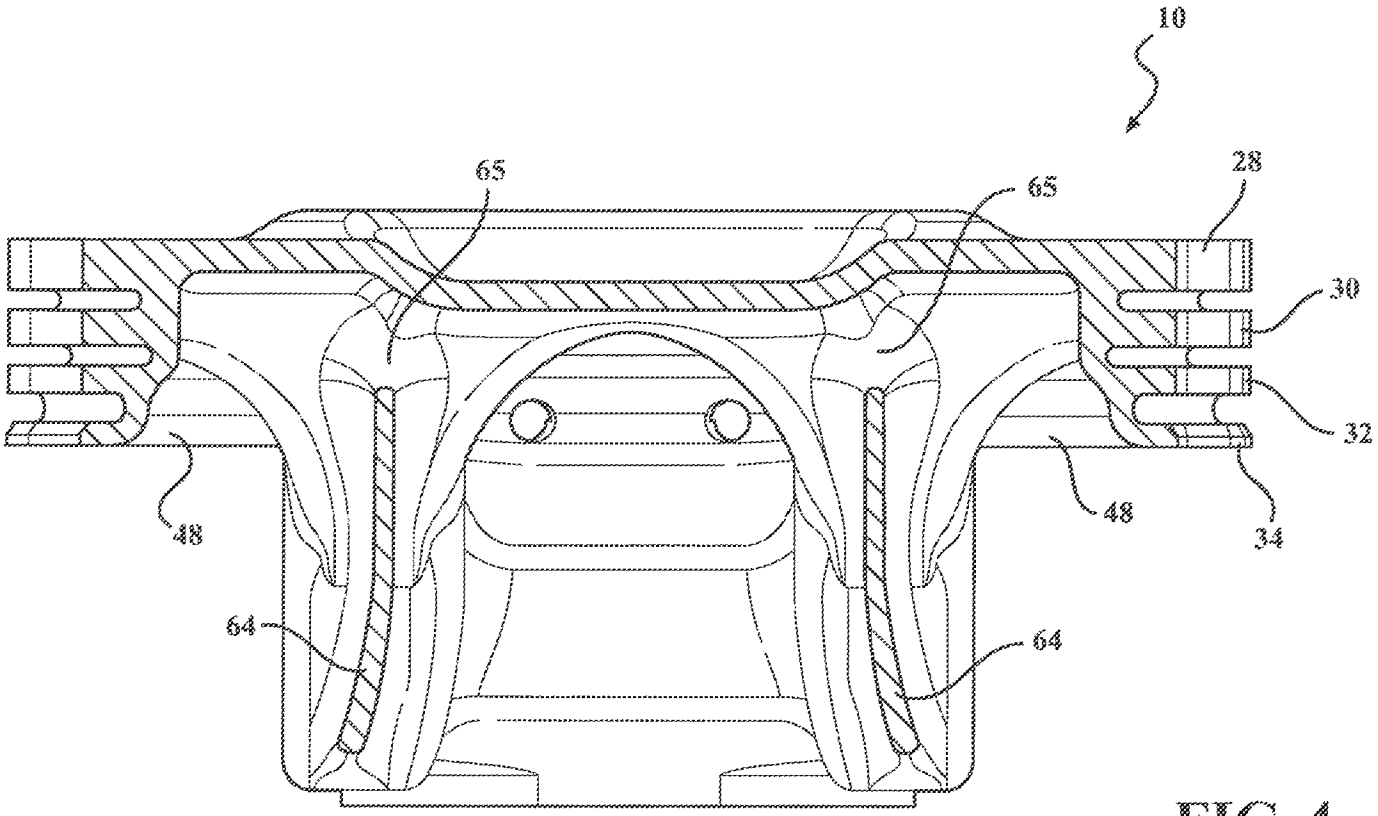
FIG. 4 is a cross sectional view similar to FIG. 3, but taken through the skirt panel.

As shown best in FIG. 4, the panels 64 are inwardly or outwardly curved from a plane by at least 0.7 mm (inward or outward) and provide rigidity to the panels 64 and thus the skirts 52 where needed.

Figure 5:
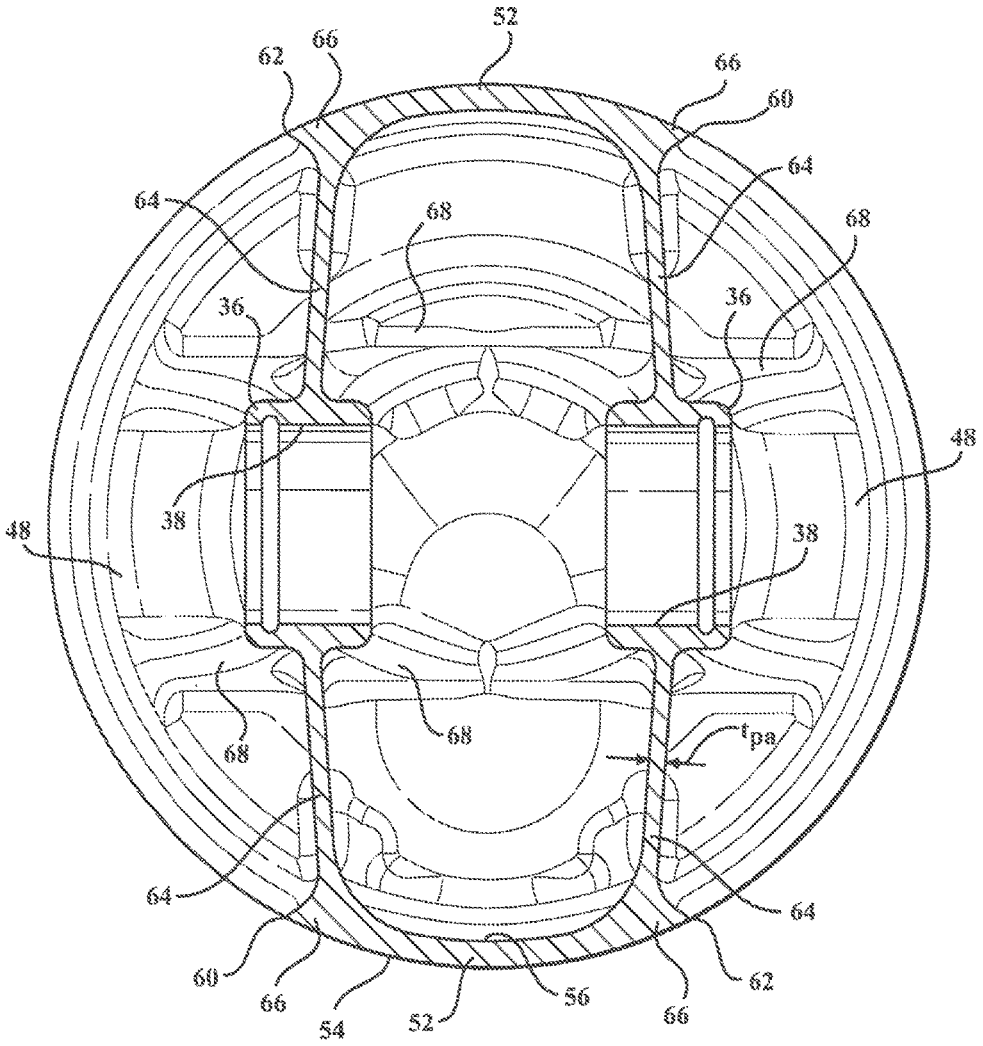
FIG. 5 is a cross sectional view of the piston of FIG. 1 taken along the pin bore axis.
Figure 6:
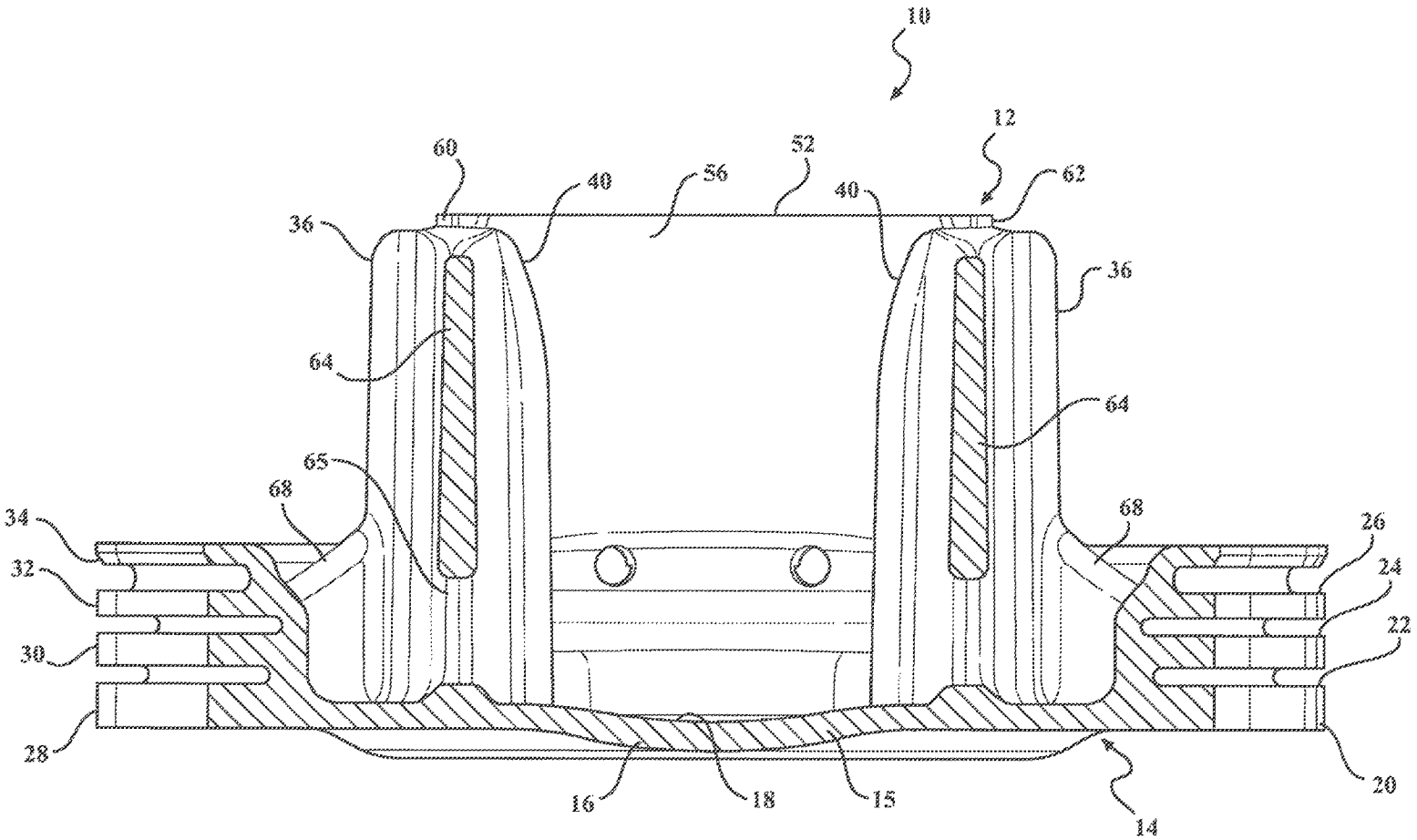
FIG. 6 is another cross sectional view of the piston of FIG. 1.

As shown best in FIGS. 5 and 10, each skirt 52 has a pair of skirt wings 66 that project beyond the panels 64 by more than 1 mm. The wings 66 of such size reduce skirt edge loading during operation of the piston 10.

Figure 7:
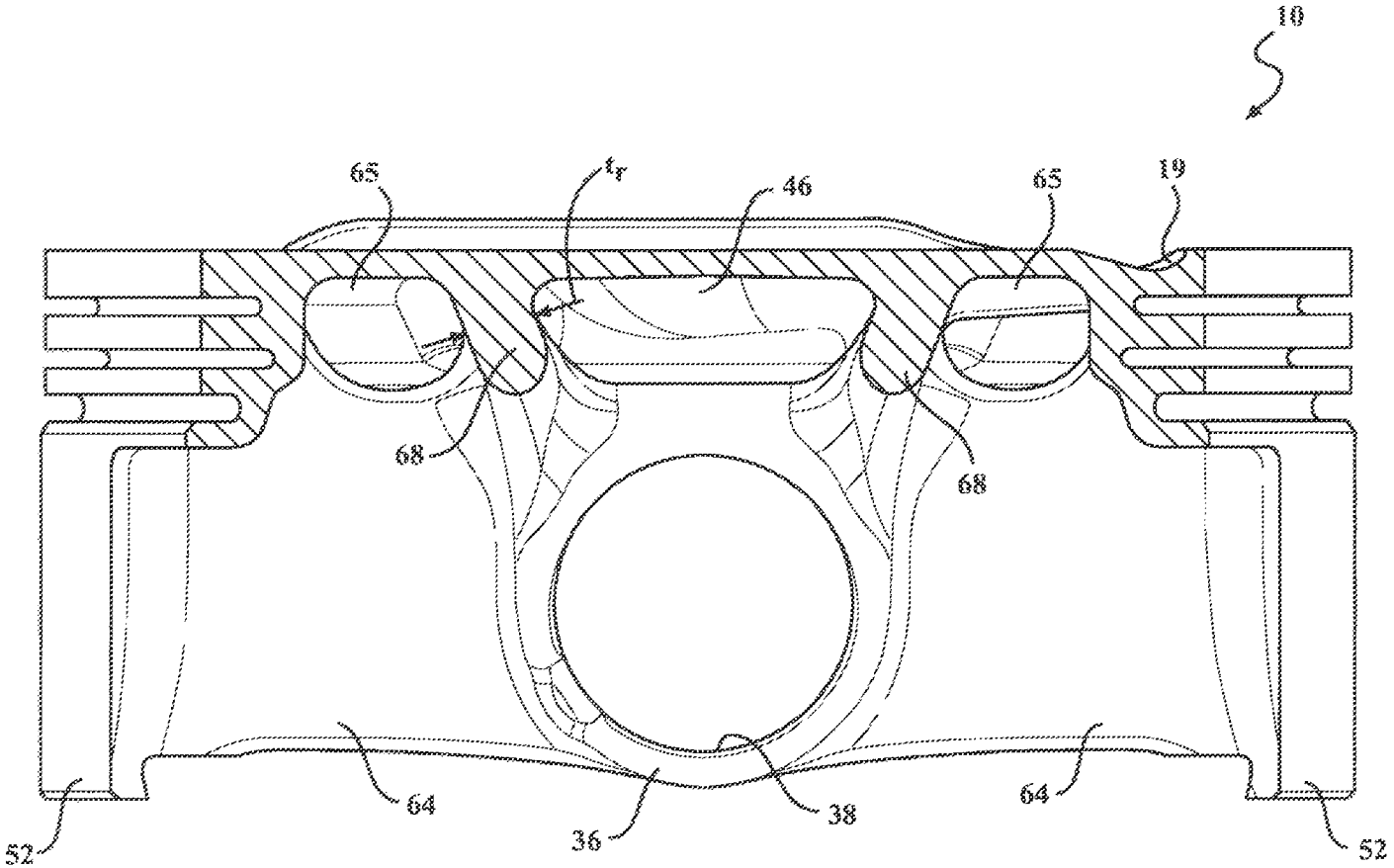
FIG. 7 is yet another cross sectional view of the piston of FIG. 1.

The undercrown surface 18, piston skirts 52 and skirt panels 64 may be provided with one or more strengthening ribs 68 that have a thickness $t_r$ <4% of the bore diameter BD. The ribs 68 provide added strength and rigidity where needed without increasing the thickness of the entire crown 14, skirts 52, or panels 64. The ribs 68 are best shown in FIGS. 5, 7 and 10. In the example embodiment, a rib 68 extends radially outwardly from each of the pin boss piers 50. The ribs 68 can be used to provide stiffness to the crown 14, spread load from the pin bosses 36 to the undercrown surface 18, and prevent the lands 28, 30, 32, 34 from drooping.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

What is claimed is:

1. A piston, comprising:

a piston body and piston crown formed of a ferrous material;

said piston crown including a crown wall presenting an undercrown surface for being exposed to cooling oil during operation;

said piston body presenting a bore diameter being the largest outer diameter of said piston body;

said piston body including a pair of pin bosses extending from said piston crown, each of said pin bosses including an inner face forming a pin bore surrounding a pin bore axis;

each of said pin bosses having an axial thickness of less than 3.7% of said bore diameter measured between said pin bore and said piston crown at 1 mm from said inner face forming said pin bore;

each of said pin bosses having a radial thickness of less than 3% of said bore diameter measured between said pin bore and a lower end of said pin boss;

said piston crown including at least one valve pocket formed in said crown wall;

said piston crown including a ring belt extending from said upper surface, said ring belt including a plurality of ring grooves, wherein an axial clearance between said valve pocket and an uppermost one of said ring grooves is less than 1.5 mm;

wherein said piston does not include a closed oil cooling gallery along said undercrown surface; and where said piston includes a window above the pin bore of each pin boss defining a passage for oil flow.

2. The piston of claim 1, wherein said pin bores each have an upper half surface extending upwardly from said pin bore axis, said upper half surface presents a projected pin bore area being less than 10% of a total piston bore area, said total piston bore area being $\pi BD^2/4$, wherein BD is said bore diameter.

3. The piston of claim 2, wherein said inner faces forming said pin bores have a straight profile.

4. The piston of claim 1, wherein said crown wall presents an upper surface for being exposed to combustion.

5. The piston of claim 4, wherein said hollowed regions extend to within 2 mm of said undercrown surface.

6. The piston of claim 1, wherein each of said hollowed regions is bridged by a pair of pin boss piers, and each of said pin boss piers has a thickness of less than 9.5% of said bore diameter.

7. The piston of claim 1, wherein said crown wall presents an upper surface for being exposed to combustion, and said piston has a compression height measured from said pin bore axis to said upper surface of less than 30% of said bore diameter.

8. The piston of claim 1, including a pair of skirts depending from said piston crown and spaced from one another by said pin bosses, each of said skirts having an outer surface providing a projected skirt area, a combined projected skirt area of said skirts is less than 40% of a total piston bore area, said total piston bore area being $\pi BD^2/4$, wherein BD is said bore diameter.

9. The piston of claim 8, wherein said combined projected skirt area is 27% to 34% of said total piston bore area.

10. The, piston of claim 8, wherein each of said skirts includes a chord width of 30% to 60% of said bore diameter, said skirts increase in width from said chord width to said piston crown, and said skirts increase in width from said cord width to a lower end of said skirts.

11. The piston of claim 8, wherein said skirts include panels being inwardly or outwardly curved from a plane by at least 0.7 mm and skirt wings projecting beyond said panels by more than 1 mm.

12. The piston of claim 8, including at least one stiffening rib disposed along an undercrown surface of said piston crown, and/or one of said skirts.

13. The piston of claim 1, wherein said crown wall presents an upper surface for being exposed to combustion, said crown wall having a crown wall thickness extending from said upper surface to said undercrown surface, said crown wall thickness being less than 4 mm;

said piston crown including a least one valve pocket formed in said crown wall; and said piston crown including a ring belt extending from said upper surface, said ring belt including a plurality of ring grooves, wherein an axial clearance between said valve pocket and an uppermost one of said ring grooves is less than 1.5 mm.

14. The piston of claim 13, wherein said undercrown surface presents a projected undercrown area of less than 45% of a total piston bore area, said total piston bore area is $\pi BD^2/4$, BD being said bore diameter;

said pin bores each have an upper half surface extending upwardly from said pin bore axis, said upper half surface presents a projected pin bore area equal to less than 10% of said total piston bore area;

said inner faces forming said pin bores of said pin bosses have a straight profile;

said piston has a compression height measured from said pin bore axis to said upper surface of said piston crown of less than 30% of said bore diameter; and further including a pair of skirts extending from said piston crown and spaced from one another by said pin bosses, and each of said skirts having an outer surface providing a projected skirt area, and a combined projected skirt area of said skirts is less than 40% of said total piston bore area.

15. The piston of claim 14, wherein said ring grooves are spaced from one another by lands, said lands include a top land depending from said upper surface and having an axial thickness of less than 3% of said bore diameter, and a second land spaced from said top land by one of said ring grooves and having an axial thickness of less than 3.5% of said bore diameter;

said hollowed regions extend to within 2 mm of said undercrown surface;

each of said hollowed regions is bridged by a pair of pin boss piers, each of said pin boss piers having a thickness of less than 9.5% of said bore diameter;

said projected skirt area is 27% to 34% of said total piston bore area;

each of said skirts includes a chord width of 30% to 60% of said bore diameter, said skirts increase in width from said chord width to said piston crown, and said skirts increase in width from said cord width to a lower end of said skirts;

said skirts include panels inwardly or outwardly curved from a plane by at least 0.7 mm and skirt wings projecting beyond said panels by more than 1 mm; and further including at least one stiffening rib disposed along an undercrown surface of said piston crown, and/or one of said skirts; and a coating formed of manganese phosphate disposed on said inner faces of said pin bosses forming said pin bores.

* * * * *